United States Patent [19]

McGuffie et al.

[11] 3,991,291

[45] Nov. 9, 1976

[54] ENCLOSED CIRCUIT INTERRUPTER WITH DOOR MOUNTED CONTROL HANDLE MECHANISM

[75] Inventors: Alan G. McGuffie, Pittsburgh; William P. Matty, Jr., Bethel Park, both of Pa.

[73] Assignee: Westinghouse Electric Corporation, Pittsburgh, Pa.

[22] Filed: Apr. 2, 1975

[21] Appl. No.: 564,574

[52] U.S. Cl. ..... 200/50 A

[51] Int. Cl.[2] ..... H01H 9/20

[58] Field of Search ..... 200/50 A, 50 AA, 153 G, 200/153 H, 329, 330, 42 R, 42 T, 337

[56] References Cited

UNITED STATES PATENTS

| | | | |
|---|---|---|---|
| 2,695,934 | 11/1954 | Wills | 200/50 A |
| 2,916,904 | 12/1959 | Christensen et al. | 200/42 T UX |
| 2,946,865 | 7/1960 | Thomas | 200/50 A |
| 3,141,074 | 7/1964 | Rexroad | 200/50 A |
| 3,229,056 | 1/1966 | Turnbull | 200/42 T UX |
| 3,311,720 | 3/1967 | Johnson | 200/42 T UX |

*Primary Examiner*—James R. Scott
*Attorney, Agent, or Firm*—R. E. Converse, Jr.

[57] ABSTRACT

A handle mounted externally on the door of a sealed enclosure operates a mechanism on the inner side of the door which controls the opening and closing of a circuit breaker located within the enclosure. The handle has a detented OPEN and AUTO position and a spring returned CLOSE position. When the handle is in the OPEN position an extensor assembly moves a contact member perpendicularly away from the inner surface of the door to operate a mechanical trip plate of the associated circuit breaker. When the handle is moved to the CLOSE or AUTO position a bumper member is moved by the mechanism in a direction parallel to the inner surface of the door to selectively activate either of two switches located on a switch bracket resiliently mounted upon the associated circuit breaker. The door can be hinged from either side. The handle can be padlocked in the OPEN or AUTO position but not in the CLOSE position.

13 Claims, 12 Drawing Figures

OPEN

CLOSE

AUTO

ENCLOSED CIRCUIT INTERRUPTER WITH DOOR MOUNTED CONTROL HANDLE MECHANISM

CROSS-REFERENCE TO RELATED APPLICATIONS

This invention is related to U.S. Pat. application Ser. No. 564,573, entitled "Draw-Out Type Circuit Interrupter With Modular Construction" filed Apr. 2, 1975; U.S. Pat. application No. 564,575, entitled "Enclosed Circuit Interrupter With Interlocked Safety Barrier" filed Apr. 2, 1975; U.S. Pat. application Ser. No. 564,576, entitled "Enclosed Circuit Interrupter With Improved Fuse Assembly" filed Apr. 2, 1975; U.S. Pat. Application Ser. No. 564,577, entitled "Drawout Type Circuit Interrupter With Interlocked Levering Mechanism" filed Apr. 2, 1975; and U.S. Pat. application Ser. No. 438,059, entitled "Gasket Assembly for Enclosed Electrical Apparatus" filed Jan. 30, 1974, by Edmund W. Kuhn. Each of the above-mentioned applications is assigned to the assignee of the present invention.

BACKGROUND OF THE INVENTION

1. Field of the Invention:

The invention relates generally to electrical apparatus and more particularly to handle operating mechanisms for enclosed circuit interrupters.

2. Description of the Prior Art:

Circuit interrupters are widely used in industrial utilities and commercial applications to provide control of electrical circuits. Often these circuit interrupters must be located in environments where they are subjected to severe moisture or dust conditions or are even completely submerged. Thus it is required that they be mounted within sealed enclosures. These enclosures are often supplied with fittings to allow pressurization of the interior for leak testing and to prevent any possibility of water leakage into the enclosure.

It is extremely useful to be able to operate the circuit interrupter between its various operating positions without opening the enclosure, thereby eliminating the necessity for repressurization of the enclosure and preventing any possibility of operating personnel coming in contact with circuit interrupter components at high potential. Prior art operating mechanisms for enclosed switchgear were often located at the side of the enclosure, producing problems where installation space was limited. In addition, in order to obtain desired flexiblility it was necessary to provide for mounting of the mechanism on either side of the enclosure. This in turn necessitated an opening on either side of the enclosure, one of which was not used and had to be sealed. Alternatively, two styles of enclosures were required, one for left-hand mounting and one for right-hand mounting. Thus, it would be desirable to provide a control handle mechanism adapted for mounting upon the door of an enclosure. In addition it is desirable to provide a mechanism which will allow the door to be hinged from either side, and to provide for operation of the circuit interrupter despite minor misalignment of the door and enclosure.

In order to prevent unauthorized operation, it is desirable to provide capability to padlock the control handle in certain positions but to prevent the circuit interrupter from being locked into a closed position.

In many instances, enclosed circuit interrupters are installed in underground vaults and must be lowered into or raised out of the vault by means of a crane or winch. Prior art control handle mechanisms were often susceptible to damage during the raising and lowering operation. Thus it is desirable to provide a handle which will minimize damage if struck when the enclosure is being installed or removed.

Often a circuit breaker must be operated from a remote location using a rope or lanyard. It is desirable to provide a handle which is adapted for such operation.

Safety considerations dictate that a circuit interrupter be opened mechanically as well as electrically. Thus it is desirable that a control handle mechanism provide for mechanical opening of the enclosed circuit interrupter.

SUMMARY OF THE INVENTION

In accordance with the principles of the present invention, there is provided an enclosed circuit interrupter comprising an enclosure, a door providing access to the interior of the enclosure, a circuit interrupter mounted within the enclosure, and a control handle mechanism mounted upon the enclosure door. The control handle mechanism comprises a handle mounted on the external surface of the and an extensor assembly mounted upon the interior suface of the door. The extensor assembly includes a contact member adapted for actuation of mechanical trip means of the circuit breaker. Operation of the extensor assembly causes movement of the contact member in the direction perpendicular to the surface of the door. The control handle mechanism also includes a bumper assembly mounted on the interior surface of the door. The bumper assembly includes a bumper member attached to the door and adapted for movement in the direction parallel to the surface of the door. When operated, the bumper assembly causes the bumper member to selectively activate electrical operating means of the enclosed circuit interrupter. Means are provided for connecting the operating handle with the extensor assembly and the bumper assembly so that operation of the handle causes operation of the extensor assembly and the bumper assembly, thereby actuating the operating means of the enclosed circuit interrupter.

The operating handle has a tapered shape so as to minimize damage if struck when the enclosure is lowered into or raised out of the underground vault. The handle also includes an arrow-type projection at one end adapted for connection to a lanyard for remote operation and a latch plate allowing the handle to be padlocked in the TRIP and AUTO positions, but not in the CLOSE position. The control handle mechanism allows the door to be hinged from either side, and allows operation of the circuit breaker despite minor disalignment of the door and enclosure.

DESCRIPTION OF THE PREFERRED EMBODIMENT

Figure 1:
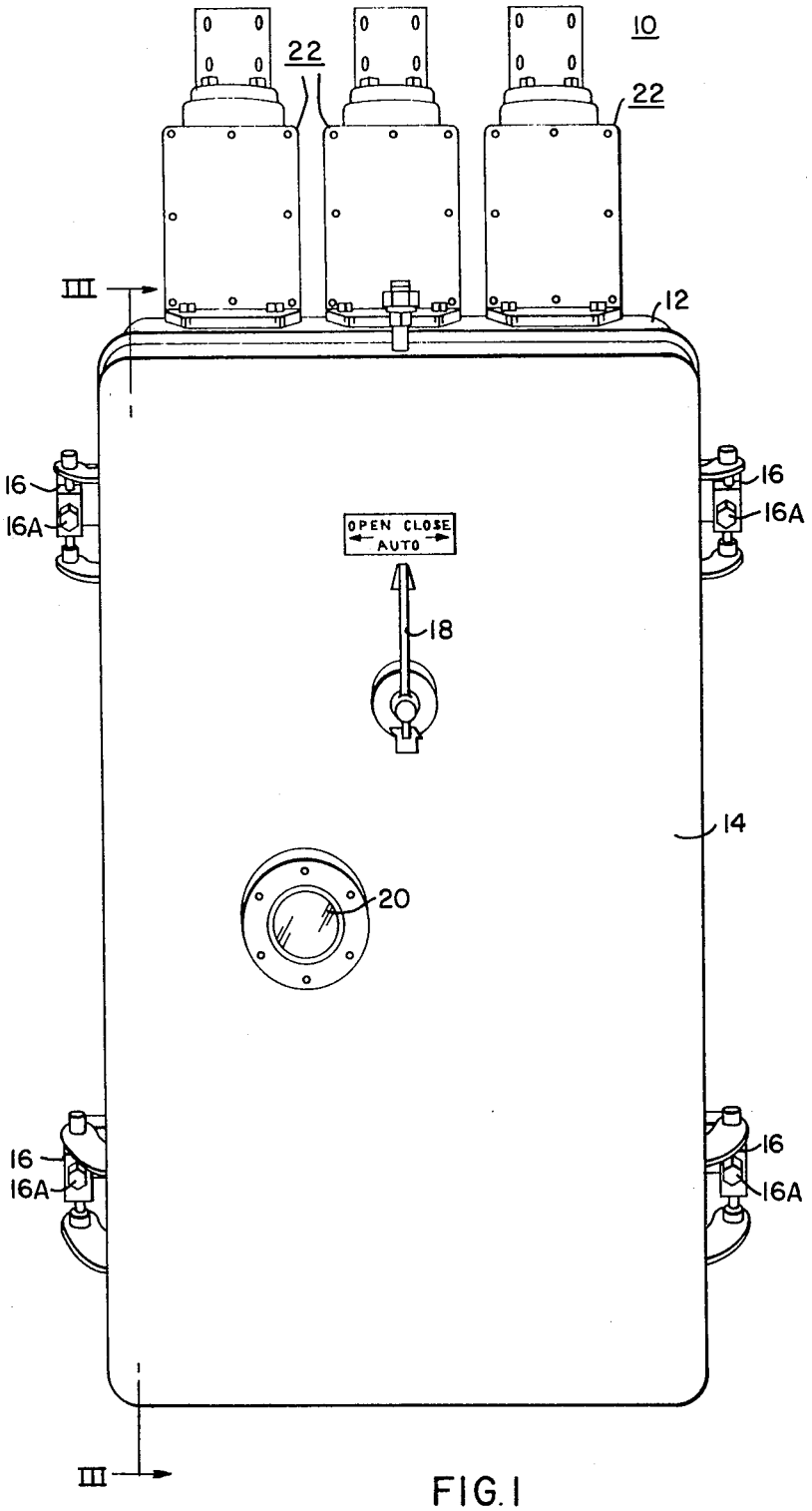
FIG. 1 is a front elevational view of a network protector employing the principles of the present invention.
Figure 2:
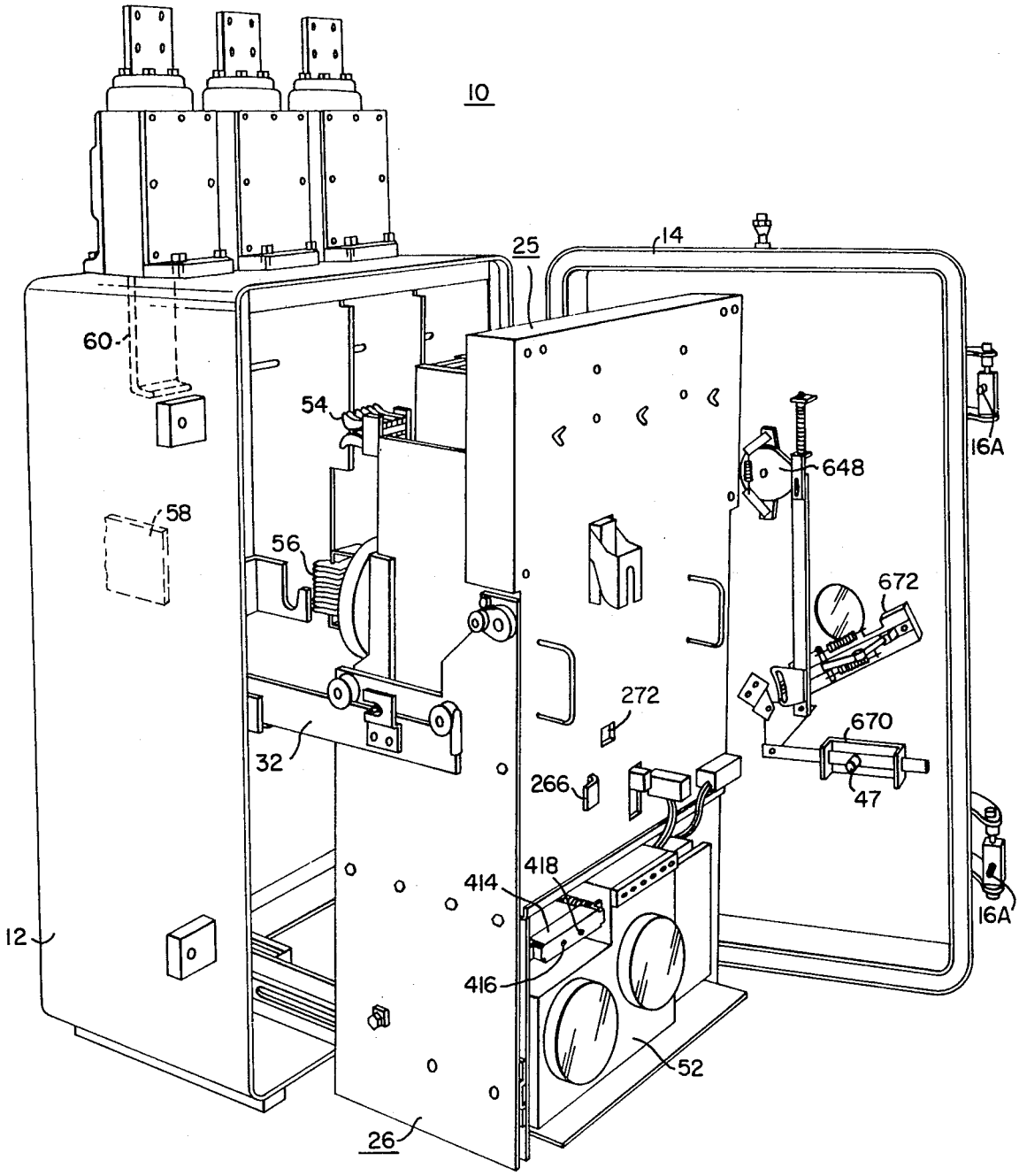
FIG. 2 is a perspective view of the network protector of FIG. 1, shown with the door open.

Throughout the drawings corresponding reference characters refer to corresponding parts. Referring now to FIG. 1, there is shown a three-phase network protector 10 constructed according to the principles of the present invention. The network protector 10 includes an enclosure 12 and a door 14, mounted upon hinged fasteners 16. The hinged fasteners 16 on either side of the door 14 are identical except for the length of the bolts 16A extending therethrough, and the presence of a spring and stop nut on the hinge side. Shorter bolts 16A are employed on the side of the door which is to open, for example, the bolts 16A on the left side as shown in FIG. 2 of the described embodiment. Mounted atop the enclosure 12 are three fuse assemblies 22 described more completely in the aforementioned copending U.S. Pat. application Ser. No. 564,576, entitled "Enclosed Circuit Interrupter With Improved Fuse Assembly". The door 14 includes a control handle 18 and a window 20 to allow an operator to view the position of an indicator flag 272 (FIG. 2).

Referring now to FIG. 2, the network protector 10 includes a drawout unit 26 movably supported upon rails 32 within the enclosure 12. The drawout unit 26 includes an automatic circuit breaker 25 which is more completely described in the aforementioned U.S. Pat. application Ser. No. 564,573, entitled "Draw-Out Type Circuit Interrupter With Modular Construction". Conductors from a network transformer terminate in line terminals 58 located within the circuit breaker enclosure 12. Conductors from a secondary network from which customer loads are served are connected to the fuse assemblies 22 and terminate in load terminals 60 also located within the enclosure 12. When the drawout unit is rolled back upon the rails 32 into a completely inserted position within the enclosure 12, the line terminals 58 and load terminals 60 are engaged by line disconnect structures 56 and load disconnect structures 54 to bridge the contacts of the circuit breaker 25 across the line and load terminals 58, 60. Thus current flows from a network transformer to the line terminals 58 through the line disconnect structure 56, the circuit breaker 25, the load disconnects 54 to the load terminals 60, the fuse assemblies 22 and out to the secondary network.

The drawout unit 26 includes a control module 52 containing switches and relays for controlling a mechanism to operate the contacts of the automatic circuit breaker 25. The control module 52 includes a resiliently mounted switch bracket 414 containing a CLOSE microswitch 416 and an AUTO microswitch 418. Located above the control module 52 is a trip plate 266. Pressing the trip plate 266 causes the mechanism within the drawout unit 26 to mechanically open the contacts of the automatic circuit breaker 25.

The network protector 10 has two modes of operation: manual and automatic. In the manual mode, the contacts of the automatic circuit breaker 25 may be opened by pressing the trip plate 266 or by reverse current flow through the circuit breaker. Closing of the contacts is accomplished by actuating the CLOSE microswitch 416. The network protector 10 is placed in the automatic mode by actuating the AUTO microswitch 418. In this mode, the position of the circuit breaker contacts is determined by voltage and current conditions in the circuit flowing through the network protector 10. If the proper phase and voltage relationships are present, the control module 52 will actuate the mechanism to cause the circuit breaker contacts to close. Again, if current flow should be reversed through the circuit breaker, the control module 52 will cause the breaker contacts to open.

Figure 3:
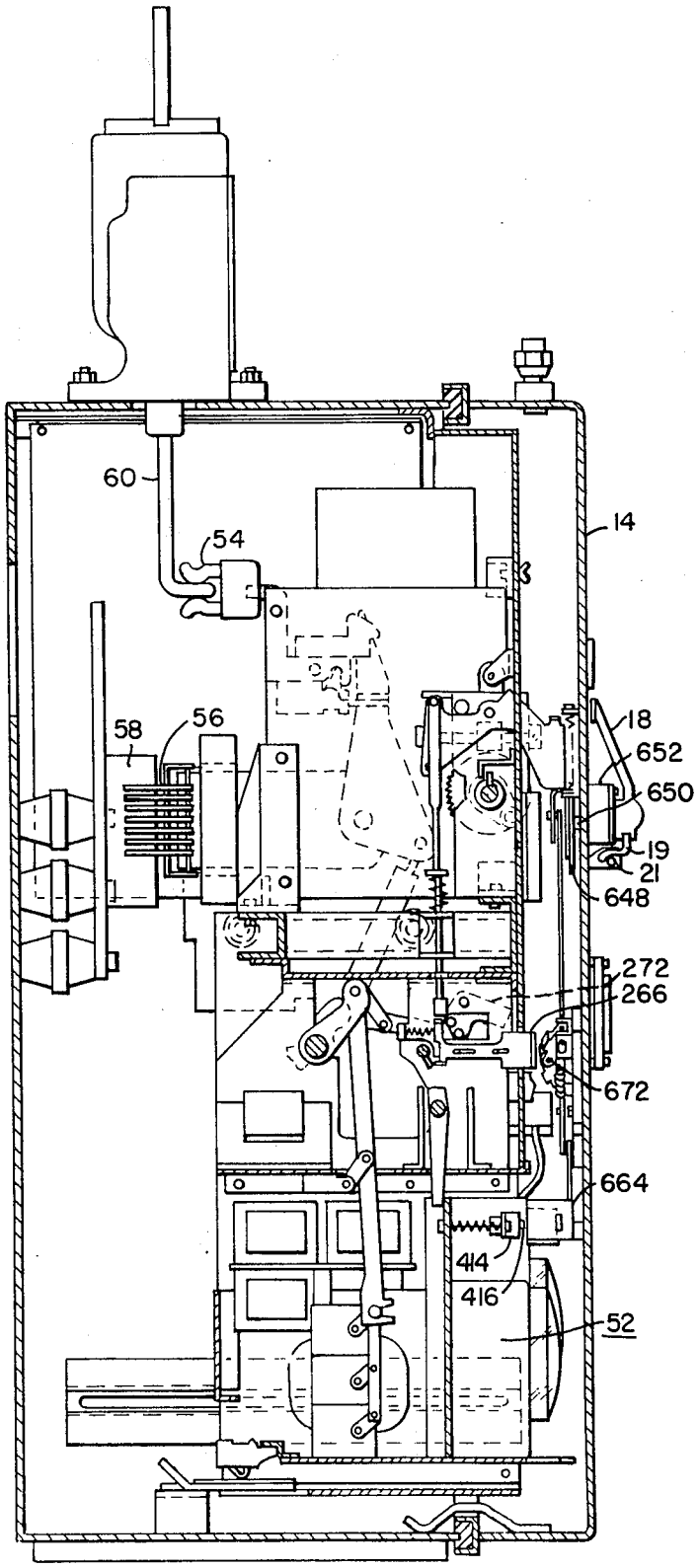
FIG. 3 is a sectional view of the network protector taken substantially along the line III—III of FIG. 1.

Referring now to FIG. 3, the control handle 18 is connected to an operating lever 648 on the inside of the door 14 through a shaft 650 and an O ring waterproof seal 652.

Figure 4:
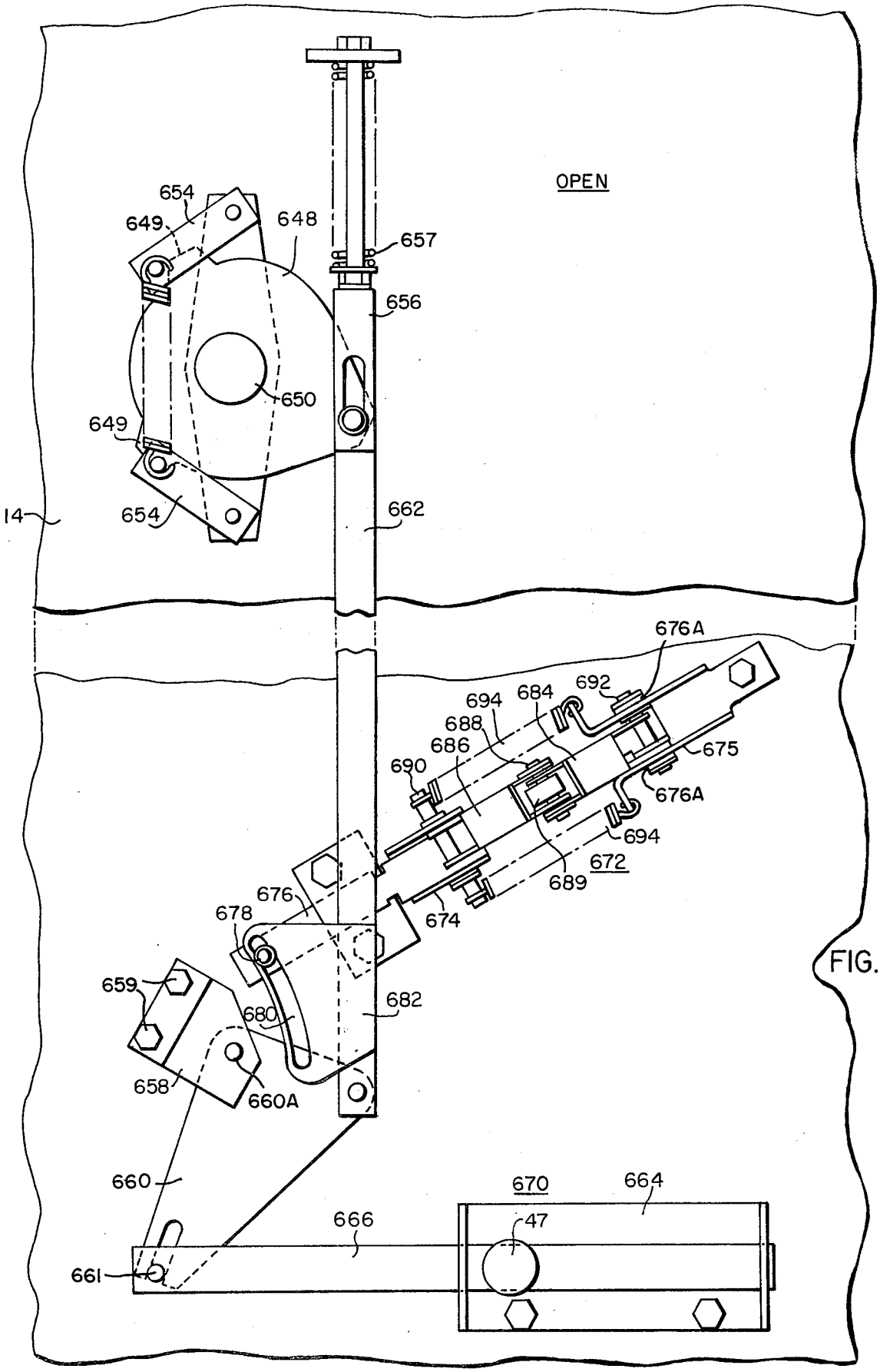
FIG. 4 is a front elevational view of the control mechanism shown in FIG. 2 with the mechanism in the OPEN position.

In FIG. 4, the operating lever 648 carries projections 649 which are operated on by two spring-loaded levers 654. The levers 654 can latch the operating lever 648 in the TRIP or AUTO position. A link 656 loaded by a spring 657 is connected to the operating lever 648 through a lost motion connection and serves to return the operating lever 648 from the CLOSE to the AUTO position.

Figure 5:
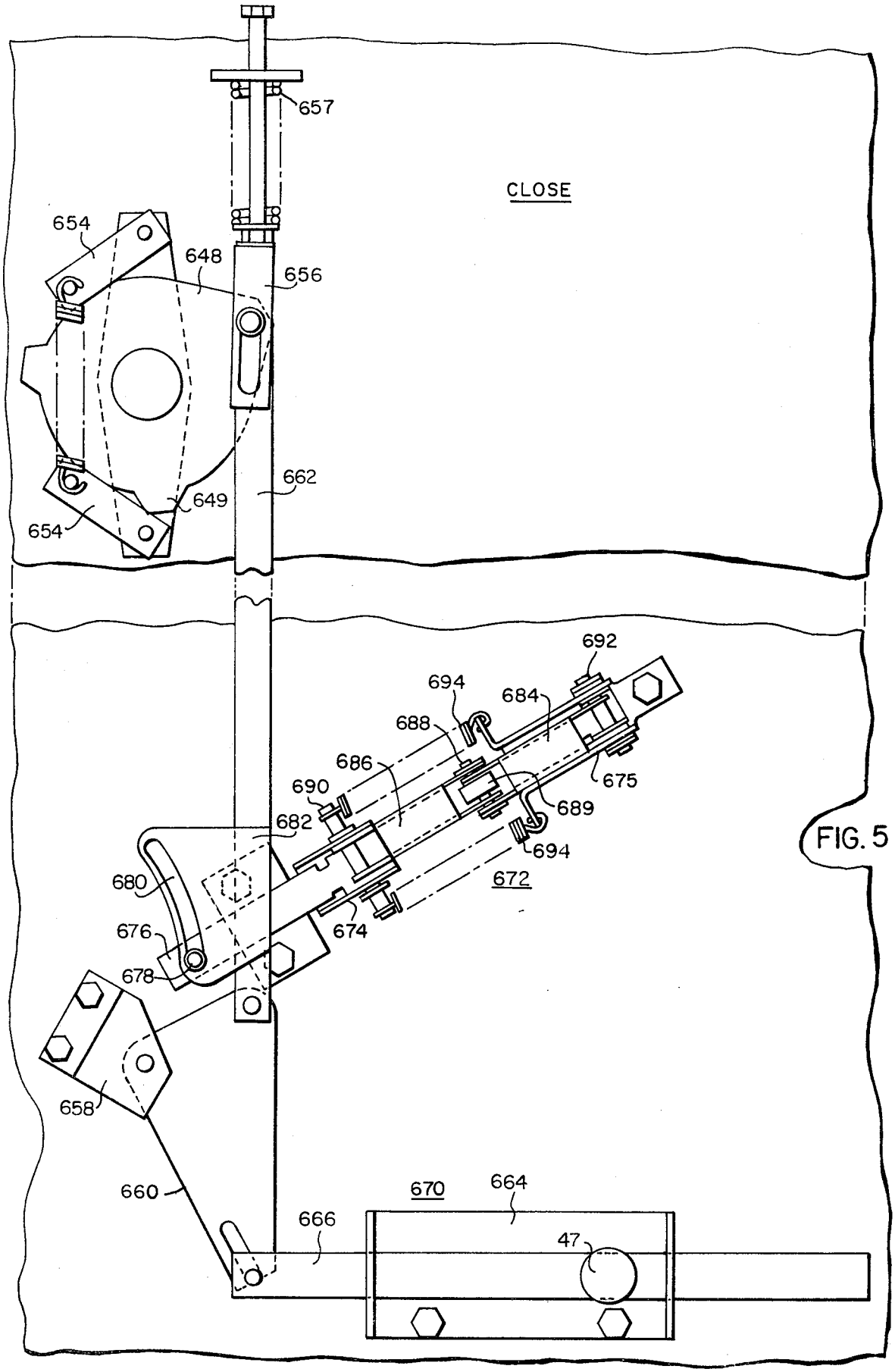
FIG. 5 is a view similar to FIG. 4 with the control mechanism shown in the CLOSE position.
Figure 6:
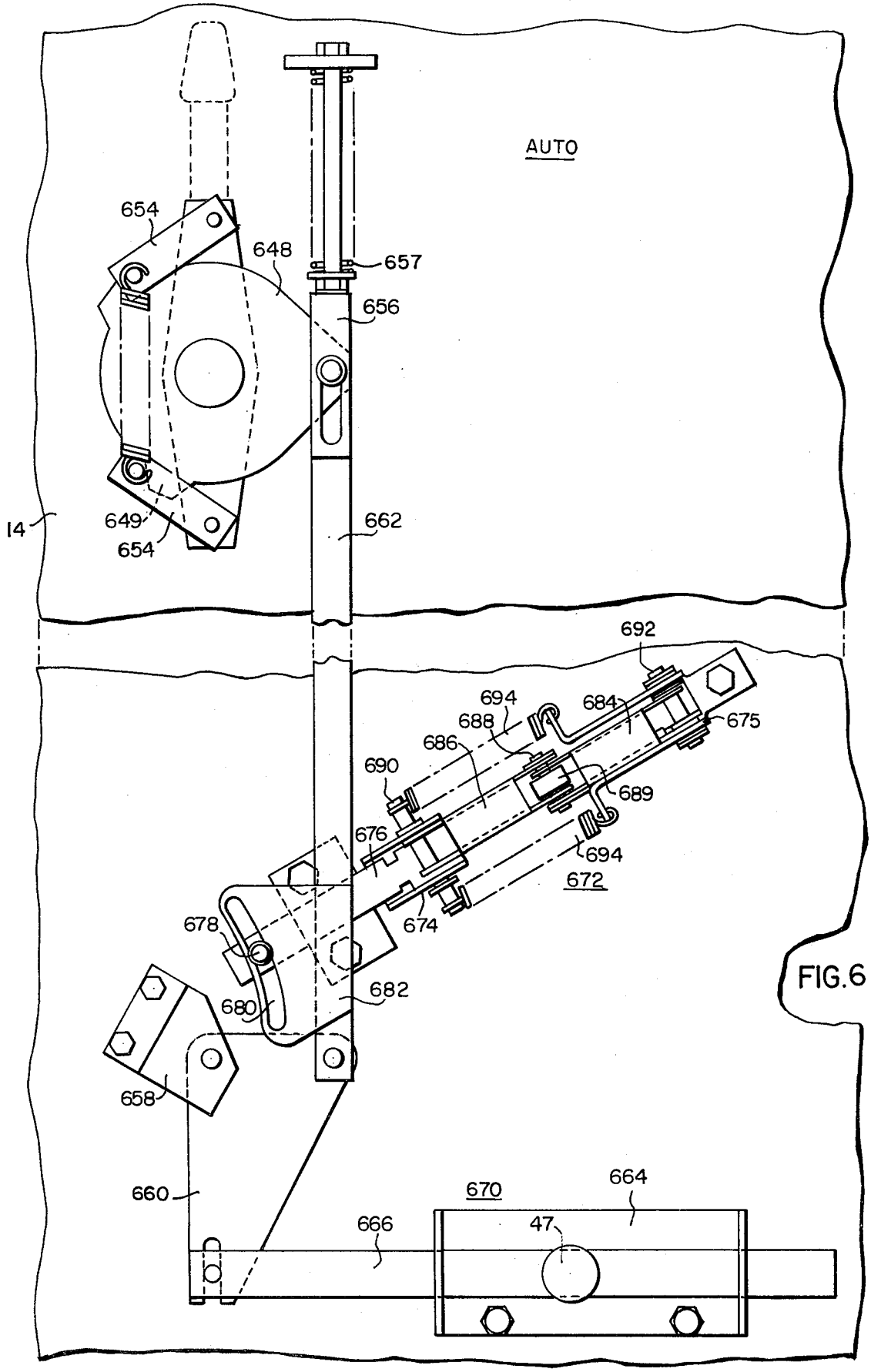
FIG. 6 is a view similar to FIGS. 4 and 5 with the control mechanism shown in the AUTO position.
Figure 7:
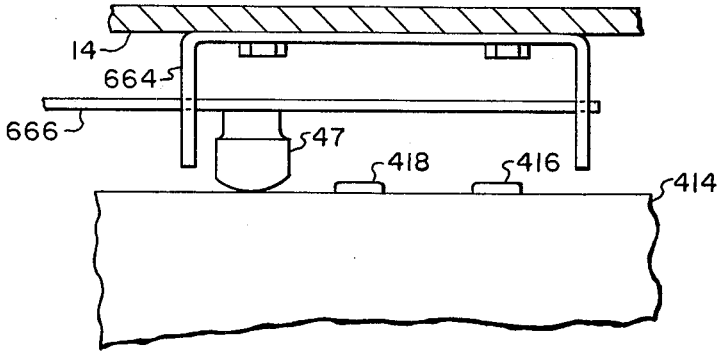
FIG. 7 is a top view of the control mechanism bumper assembly and associated switch structure shown in FIG. 2, with the control mechanism in the OPEN position.

As can be seen in FIGS. 4, 5 and 6, a bracket 658 is mounted by bolts 659 upon the door 14 below the operating lever 648. The bracket 658 pivotally supports a crank 660 at the point 660A. A link 662 is pivotally connected at one end to the operating lever 648 and at the other end to the crank 660.

A U-bracket 664 mounted to the interior surface of the door 14 slidingly supports a bar 666 which is pivotally connected by a lost-motion connection to the crank 660 at the point 661. A bumper member 47 is attached to the bar 666 intermediate the arms of the U-bracket 664. Rotation of the control handle 18 causes corresponding rotation of the operating lever 648, reciprocating movement of the link 662 and pivotal movement of the crank 660. The pivotal motion of the crank 660 in turn causes horizontal reciprocating movement of the bar 666 and bumper member 47 in a plane parallel to the interior surface of the door 14. The U-bracket 664, bar 666, and bumper member 47 thus form a bumper assembly 670.

Figure 12:
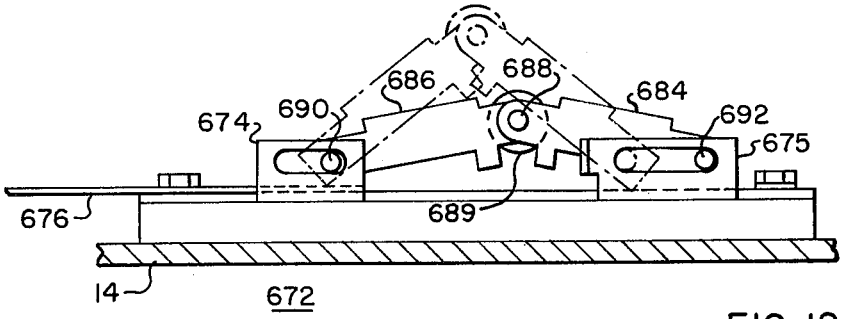
FIG. 12 is a side view of the extensor assembly shown in the collapsed position, with the extended position shown in dashed lines.

An extensor assembly 672 mounted to the interior surface of the door 14 above the bumper assembly 670 includes a connecting arm 676 and a plate having a pair of slotted brackets 674 and 675. The arm 676 includes a pin 678 constrained by an arcuate slot 680 formed in a plate 682 attached to the link 662 intermediate its two ends. Vertical reciprocating movement of the link 662 and slotted plate 682 produces corresponding reciprocating movement of the pin 678 and connecting arm 676 in a direction parallel to a line connecting the two slotted brackets 674 and 675 in a plane parallel to the inner surface of the door 14. The extensor assembly 672 also comprises a travelling arm 684 and a stationary arm 686 pivotally connected as at 688 (FIG. 12). The other end of each of the arms 686 and 684 are located by pins 690 and 692 in the slotted bracket 674 and 675 respectively. The pin 692 also passes through an extension 676A of the connecting arm 676. Tension springs 694 bias the pins 690 and 692 toward each other. However, only the pin 690 is influenced by the springs 694 to travel in its slot since the pin 692 is constrained by the extension 676 A of the connecting arm 676. Thus the pin 690 is positioned at the right-hand end of the bracket 674 as viewed in FIGS. 5, and 6, and 12. It can be seen that leftward motion of the connecting arm 676 as viewed in FIGS. 4, 5 and 6 will cause the pins 690 and 692 and the associated ends of the arms 684 and 686 to draw together. This will cause the connected ends of the arms 684 and 686 to extend outward in a direction substantially perpendicular to the inner surface of the door 14, as seen in FIGS. 4 and 12.

Figure 8:
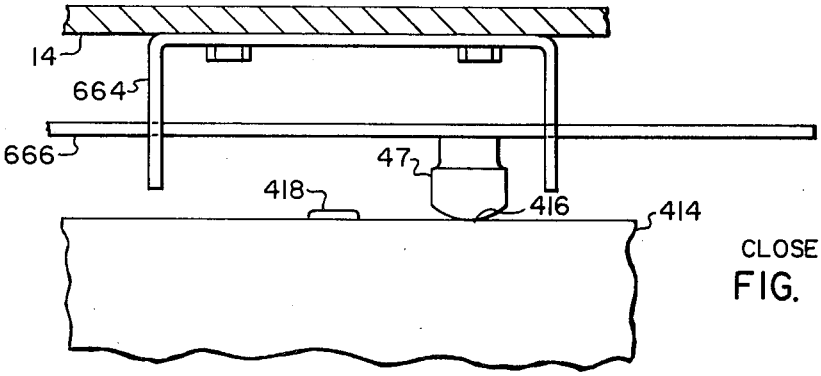
FIG. 8 is a view similar to FIG. 7 with the control mechanism in the CLOSE position.
Figure 9:
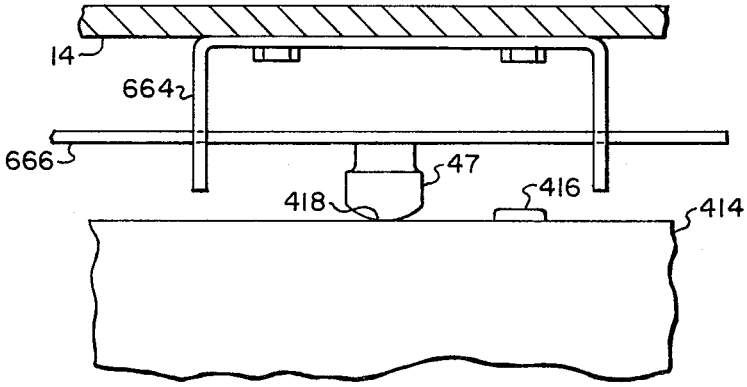
FIG. 9 is a view similar to FIGS. 7 and 8 with the control mechanism in the AUTO position.

FIGS. 4, 5 and 6 show the positon of the control mechanisms in the OPEN, CLOSE, and AUTO positions, respectively. It can be seen that when the control handle 18 and operating lever 48 are in the CLOSE position, the extensor assembly 672 is substantially collapsed, that is, the roller 689 is in a position relatively close to the surface of the door 14. The bumper member 47 is at the far right extremity of its travel, close to the right-hand arm of the U-bracket 664. As can be seen in FIG. 8, the bumper member 47 cooperates with the resiliently mounted switch bracket 414 upon the control module 52 to actuate the CLOSE microswitch 416. When the control handle 18 is moved in a counterclockwise direction as seen in FIG. 1 to the AUTO position, the control mechaniism is in the position shown in FIG. 6. As can be seen in FIGS. 6 and 9, the bumper member 47 is approximately midway between the extending arm of the U-bracket 664 and cooperates with the resiliently mounted switch bracket 414 to activate the AUTO microswitch 418. In both the CLOSE and AUTO position, the extensor assembly 672 remains in a collapsed position with the roller 689 relatively close to the surface of the door 14. When the control handle 18 is further rotated in a counterclockwise direction as seen in FIG. 1 to the OPEN position, the action of the actuate slot 680 drives the pin 678 to the upper extremity of the slot 680. This drives the connecting arm 676 leftward within the slotted brackets 674 and 675. The pin 692 is also driven leftward causing the associated end of the travelling arm 684 to be driven leftward toward the end of the stationary arm 686. This motion drives the pivot point 688 and the roller 689 outward in a direction perpendicular to the surface of the door 14. The contact member, or roller, 689 contacts the trip plate 266. Excess travel of the pin 692 and travelling arm 684 is absorbed by the action of the tension springs 694 which allow the pin 690 to move leftward as seen in FIG. 4.

Figure 10:
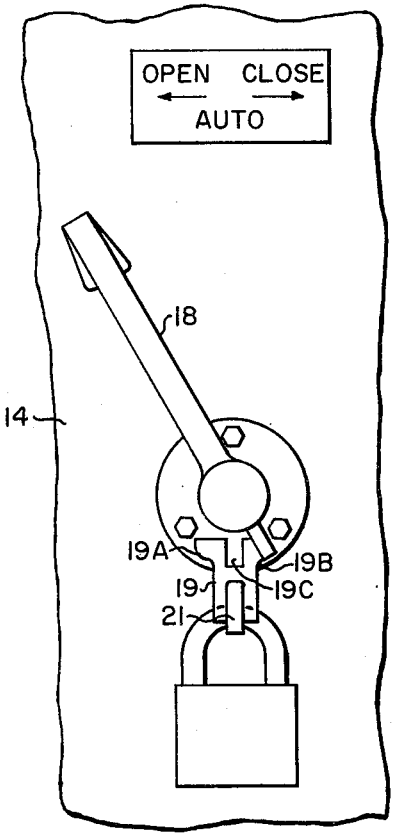
FIG. 10 is a detail front view showing the control handle padlocked in the OPEN position.
Figure 11:
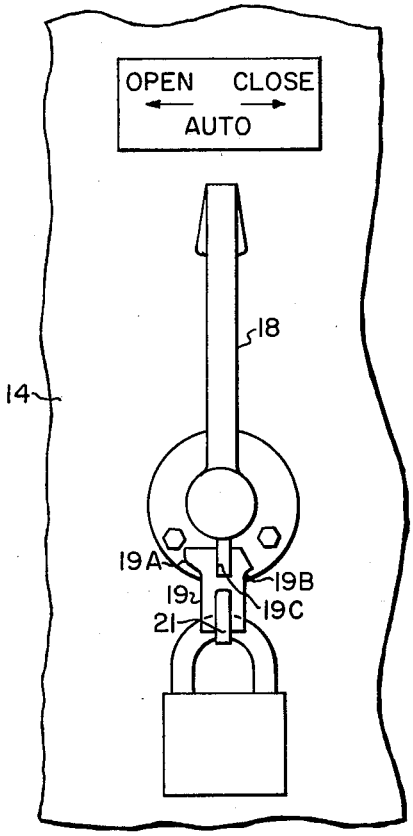
FIG. 11 is a view similar to FIG. 10, with the control handle shown padlocked in the AUTO position.

Referring to FIGS. 3, 10, and 11, the control handle 18 tapers from its point of rotation inward toward the surface of the door 14. The end of the handle 18 is formed into an arrow shaped projection. This projection provides a pointer action to indicate the operating position of the network protector 10 and also serves to provide a point of attachment for a lanyard to provide for remote operation of the handle 18. The lanyard is formed into a noose which is slipped over the end of the handle 18 and tightened around the ends of the arrow shaped projection. The end of the operating handle 18 opposite the arrow shape projection includes a short extension which cooperates with a latch plate 19 pivotally attached to the door 14 to permit the operating handle 18 to be padlocked in the TRIP and AUTO positions. Note that the latch plate 19 includes an elongated ear 19A and a short angled ear 19B separated by a slot 19C. The short ear 19B and slot 19C allow the latch plate 19 to pivot upward around the handle 18 to allow a lock to be passed through a lock plate 21 when the handle 18 is in either the OPEN or AUTO position. However, the elongated ear 19A prevents the latch plate 19 from being pivoted into position allowing a lock to be passed through the lock plate 21 when the handle 18 is in the CLOSE position. The tapered shape of the handle 18 lessens the probability that the handle will catch on an edge of the vault when being raised or lowered therefrom.

As can be seen, there is no connection between the control mechanism on the inner surface of the door 14 and the drawout unit 26. Thus the door can be hinged from either side. In addition, the action of the control mechanism is independent on the side upon which the door 14 is hinged. Due to the spring loading of the extensor assembly 672, the action of the roller 689, and the resilient mounting of the switch bracket 414, the relative position of the control mechanism upon the door 14 in relation to the drawout unit 26 is not critical. Thus minor misalignment of the door 14 will not interfere with function of the control mechanism. While the invention has been described in relation to a network protector using an automatic circuit breaker, the principles of the invention are not limited thereto, but are applicable to other types of enclosed ciricuit interrupters. It can be seen therefore that the invention provides an enclosed circuit interrrupter of more convenient construction exhibiting flexibility to allow for installation in a greater variety of environments.

We claim:

1. An enclosed circuit interrupter comprising:
an enclosure;
a door mounted upon said enclosure;
circuit interrupter means mounted within said enclosure;
circuit interrupter operating means mounted within said enclosure;
a handle mounted on the external surface of said doors;
an extensor assembly mounted upon the interior surface of said door and comprising a contact member adapted for actuation of said circuit interrupter operating means, operation of said extensor assembly moving said contact member in a direction perpendicular to the surface of said door;
a bumper assembly mounted upon the interior surface of said door and comprising a bumper member movably attached to said door and adapted for actuation of said circuit interrupter operating means, operation of said bumper assembly causing movement of said bumper member in a direction parallel to the surface of said door; and
means connecting said handle said extensor assembly and said bumper assembly;
operation of said handle causing operation of said extensor assembly and said bumper assembly to cause movement of said contact member in a direction perpendicular to the surface of said door and movement of said bumper member parallel to the surface of said door to actuate said circuit interrupter operating means.

2. An enclosed circuit interrupter as recited in claim 1 wherein said circuit interrupter operating means comprises mechanical circuit interrupter operating means and electrical circuit interrupter operating means.

3. An enclosed circuit interrupter as recited in calim 2 wherein said contact member is adapted for actuation of said mechanical circuit interrupter operating means, and said bumper member is adapted for actuation of said electrical circuit interrupter operating means.

4. An enclosed circuit interrupter as recited in claim 3 wherein said electrical circuit interrupter operating means is resiliently mounted upon said circuit interrupter means.

5. An enclosed circuit interrupter as recited in claim 4 wherein said extensor assembly comprises a stationary arm and a traveling arm, each arm having first and second ends, said first arm ends being pivotally connected together, said second end of said stationary arm being pivotally connected to said door and said second end of said traveling arm being pivotally connected to said connecting means, said contact member being attached to the point of connection of said first arm ends, operation of said extensor assembly causing said second arm ends to draw together in a direction parallel to the surface of said door and move said contact member in a direction perpendicular to the surface of said door.

6. An enclosed circuit interrupter as recited in claim 4 wherein said bumper assembly comprises a bar slidably attached to said door and adapted for longitudinal sliding movement, said bumper member being fixedly attached to said bar.

7. An enclosed circuit interrupted as recited in claim 5 wherein said bumper assembly comprises a bar slidably attached to said door and adapted for longitudinal sliding movement, said bumper member being fixedly attached to said bar.

8. An enclosed circuit interrupter recited in claim 7 wherein said connecting means comprises:

an operating lever rotatably mounted on the interior surface of said door;

means connecting said handle and said operating lever;

a crank pivotally attached to said door and adapted to pivot about an axis perpendicular to the surface of said door, said bumper assembly bar being pivotally connected to said crank; and a link pivotally connected at one end to said operating lever and pivotally connected at the other end to said crank, said link being connected to said extensor assembly;

rotation of said handle causing rotation of said operating lever and longitudinal movement of said link, said movement causing operation of said bumper assembly and said extensor assembly to cause movement of said bumper member parallel to the surface of said door and movement of said contact member perpendicular to the surface of said door, thereby actuating said mechanical and electrical circuit interrupter operating means.

9. A control mechanism adapted for mounting upon the door of an associated enclosed circuit interrupter, comprising:

a handle mounted on the external surface of said door;

an extensor assembly mounted upon the interior surface of said door comprising a contact member adapted for actuation of operating means of said associated circuit interrupter, operation of said extensor assembly causing movement of said contact member in the direction perpendicular to the surface of said door;

a bumper assembly mounted upon the interior surface of said door comprising a bumper member movably attached to said door and adapted for actuation of operating means of said associated circuit interrupter, operation of said bumper assembly causing movement of said bumper member in a direction parallel to said door; and means connecting said handle with said extensor assembly and said bumper assembly;

operation of said handle causing operation of said extensor assembly and said bumper assembly to cause movement of said contact member in a direction perpendicular to the surface of said door and movement of said bumper member in a direction parallel to the surface of said door, thereby actuating said associated circuit interrupter operating means.

10. A control mechanism as recited in claim 9 wherein said extensor assembly comprises a stationary arm and a traveling arm, each arm having first and second ends, said first arm ends being pivotally connected together, said second end of said stationary arm being pivotally connected to said door and said second end of said traveling arm being pivotally connected to said connecting means, said contact member being attached to the point of connection of said first arm ends, operation of said extensor assembly causing said second arm ends to draw together in a direction parallel to the surface of said door and move said contact member in a direction perpendicular to the surface of said door.

11. A control mechanism as recited in claim 9 wherein said bumper assembly comprises a bar slidably attached to said door and adapted for longitudinal sliding movement, said bumper member being fixedly attached to said bar.

12. A control mechanism as recited in claim 10 wherein said bumper assembly comprises a bar slidably attached to said door and adapted for longitudinal sliding movement, said bumper member being fixedly attached to said bar.

13. A control mechanism as recited in claim 12 wherein said connecting means comprises:

an operating lever rotatably mounted on the interior surface of said door;

means connecting said handle and said operating lever;

a crank pivotally attached to said door and adapted to pivot about an axis perpendicular to the surface of said door, said bumper assembly bar being pivotally connected to said crank; and a link pivotally connected at one end to said operating lever and pivotally connected at the other end to said crank, said link being connected to said bumper assembly;

rotation of said handle causing rotation of said operating lever and longitudinal movement of said link, said movement causing operation of said bumper assembly and said extensor assembly to cause movement of said bumper member parallel to the surface of said door and movement of said contact member perpendicular to the surface of said door, thereby actuating said associated circuit interrupter operating means.

* * * * *